US006978497B1

(12) United States Patent
Takizawa

(10) Patent No.: US 6,978,497 B1
(45) Date of Patent: Dec. 27, 2005

(54) MOTIVATIVE EXERCISE AND LIFTING AID DUAL DEVICE

(76) Inventor: Shigeo Takizawa, 24-5, Shounandai 4-chome, Fujisawa-shi (JP) 252-0804

( * ) Notice: Subject to any disclaimer, the term of this patent is extended or adjusted under 35 U.S.C. 154(b) by 30 days.

(21) Appl. No.: 10/311,917

(22) PCT Filed: Jun. 21, 2000

(86) PCT No.: PCT/JP00/04062

§ 371 (c)(1),
(2), (4) Date: Mar. 4, 2003

(87) PCT Pub. No.: WO02/03904

PCT Pub. Date: Jan. 17, 2002

(51) Int. Cl.[7] ..... A61G 7/10
(52) U.S. Cl. ..... 5/86.1; 5/87.1
(58) Field of Search ..... 5/86.1, 81.1 R, 5/83.1, 85.1, 87.1, 89.1; 16/18 R, 18 CG, 16/18 B

(56) References Cited

U.S. PATENT DOCUMENTS

| | | | | | |
|---|---|---|---|---|---|
| 562,725 | A * | 6/1896 | Hepburn | 5/87.1 |
| 686,425 | A * | 11/1901 | Sommerfeld | 5/86.1 |
| 924,754 | A * | 6/1909 | Fosdick | 5/86.1 |
| 3,131,404 | A * | 5/1964 | Bowers et al. | 5/86.1 |
| 3,184,783 | A * | 5/1965 | Brigham | 16/18 R |
| 3,239,872 | A * | 3/1966 | Kitrell | 16/18 R |
| 5,077,844 | A * | 1/1992 | Twitchell et al. | 5/87.1 |
| 5,911,422 | A * | 6/1999 | Carpenter et al. | 280/8 |
| 6,625,846 | B2 * | 9/2003 | Takizawa | 16/20 |
| 2002/0088083 | A1 * | 7/2002 | Takizawa | 16/45 |

FOREIGN PATENT DOCUMENTS

| | | | |
|---|---|---|---|
| GB | 2242885 A * | 10/1991 | A61G 7/14 |
| JP | 07-139630 U | 11/1990 | |
| JP | 04-288160 | 10/1992 | |
| JP | 07-236670 | 12/1995 | |
| JP | 08-196569 | 8/1996 | |
| JP | 09-108277 | 4/1997 | |
| JP | 10-094566 | 4/1998 | |
| JP | 10-286290 | 10/1998 | |
| JP | 10-305704 | 11/1998 | |

* cited by examiner

*Primary Examiner*—Robert G. Santos

(57) ABSTRACT

A lift device capable of performing an activating motion having a part suspension device for training an upper limb capable of easily and surely performing an upper limb activating motion and easy to handle and use such that it is free to pass over a sill height difference, comprising leg parts (3*a*, 3*b*) with a caster (2) having a sliding run-over plate (1), an equipment storage part (4), wheels (5), a lifting guide (6) installed erectedly on the equipment storage part by fixing one end thereof to the storage part, a lifting part (7) provided inside the lifting guide, a lifting drive part (9) drivingly lifting the lifting part, a lifting drive control part (10) controlling the lifting drive part, an operation towing arm (8) installed on the lifting part, part suspension device mounting devices (11) and (12) for training an upper limb, installed on the equipment storage part, a mounting hole (13) for the pan suspension device for training an upper limb provided in the lifting guide, and a part suspension device (14) for training an upper limb, installed on the mounting device for part suspension device for training an upper limb.

4 Claims, 7 Drawing Sheets

MOTIVATIVE EXERCISE AND LIFTING AID DUAL DEVICE

FIELD OF THE INVENTION

This invention is for the care of gait difficulties who can not leave a bed by themselves.

This invention enables to reduce the labor of the care person and to move the handicapped patients confidently for the care work to do indoor with such as steps or gaps.

This invention is to improve a transfer-move lifting aid to use smoothly and for a lifting aid with a tying a device for training of upper extremities which enables patients to rehabilitate at home by the motivative exercise for upper extremities easily and properly.

BACKGROUND OF THE INVENTION

Many kinds of lifting aids as a handicapped person's care devices have been provided in multiple needs such as bathing assistance.

The lifting aids are used as an assistant device to make handicapped persons sit up and move easily.

However it is the most desirable that a care should effect handicapped people independent, but its realization has been difficult.

At the same time, lifts aids with wheels did not come into practical use in the situation where gaps and steps were obstacles. It is known popularly that lifting aids of ceiling tying type has been in wider use.

This inventor is applying the device for a motivative exercise of lower extremities.

The motivative exercise of lower extremities enables to prevent the contracture of equines position by the after effect of cerebrovascular disease.

And/or the motivative exercise is able to control the appearance of the spasticity by both using of the paralyzed part of the nervous system and the inhibition mechanism of controlling the mover and antagonist in order to the patients who became the condition of contracture of equines position.

It is also rational to think that the motivative exercise of upper extremities enables to_control the appearance of the spasticity by both using of the paralyzed part of the nervous system and the inhibition mechanism of controlling the mover and antagonist in order to the patients who became the condition of contracture of equines position.

This invention is intended to offer the combination device of both a motivative exercise device of upper extremities and a lifting aid;

the motivative exercise device can be used for making the handicapped people be independent form care reliance and the lifting aids can be used and handled easily in the situation where the thresholds and gaps are obstacles and to get over the obstacles without any difficulties.

This device is useful for both a care and an independence of handicapped people at home.

And, the name of the combination device of both the lifting aids and upper extremities function training device is to be "motivative exercise and lifting aid dual device."

DISCLOSURE OF THE INVENTION

The motivative exercise and lifting aid dual device is composed of leg poles (3*a*, 3*b*) which have casters (2), a hardware box (4), wheels (5), a guide (6) that attached to the hardware box, a hoisting part (7), a running-pulling arm (8), a hoisting driving part (9) that make the hoisting part go up and down and a hoisting controller (10) that controls the hoisting driving part.

A hoisting part (7) and a running-pulling arm component (8*a*) are installed in the guide (6) to control possible.

There is a case that the motivative exercise and lifting aid dual device has leg poles (3*a*, 3*b*) which has casters (2) with plates (1).

There is a case that the motivative exercise and lifting aid dual device have a member of the tying device for training of upper extremities (11) which is set up at the hardware box.

There is a case that the motivative exercise and lifting aid dual device have a member of the tying device for training of upper extremities (12) which is set up at the guide.

There is a case that the motivative exercise and lifting aid dual device have a tying device for training of upper extremities (14) which is assembled into said members of the tying device for training of upper extremities.

There is a case that the running-pulling arm (8) has a running-arm and-a pulling arm respectively.

There is a case that the running-pulling arm (8) has a hole (13) for the tying device for training of upper extremities.

There is a case that the motivative exercise and lifting aid dual device have a power-assist mechanism known in public in the wheel (5).

There is a case that the running-pulling arm (8) is removed when the tying device for training of upper extremities is set up.

DETAILED DESCRIPTION OF THE PREFERRED EMBODIMENT

Figure 1:
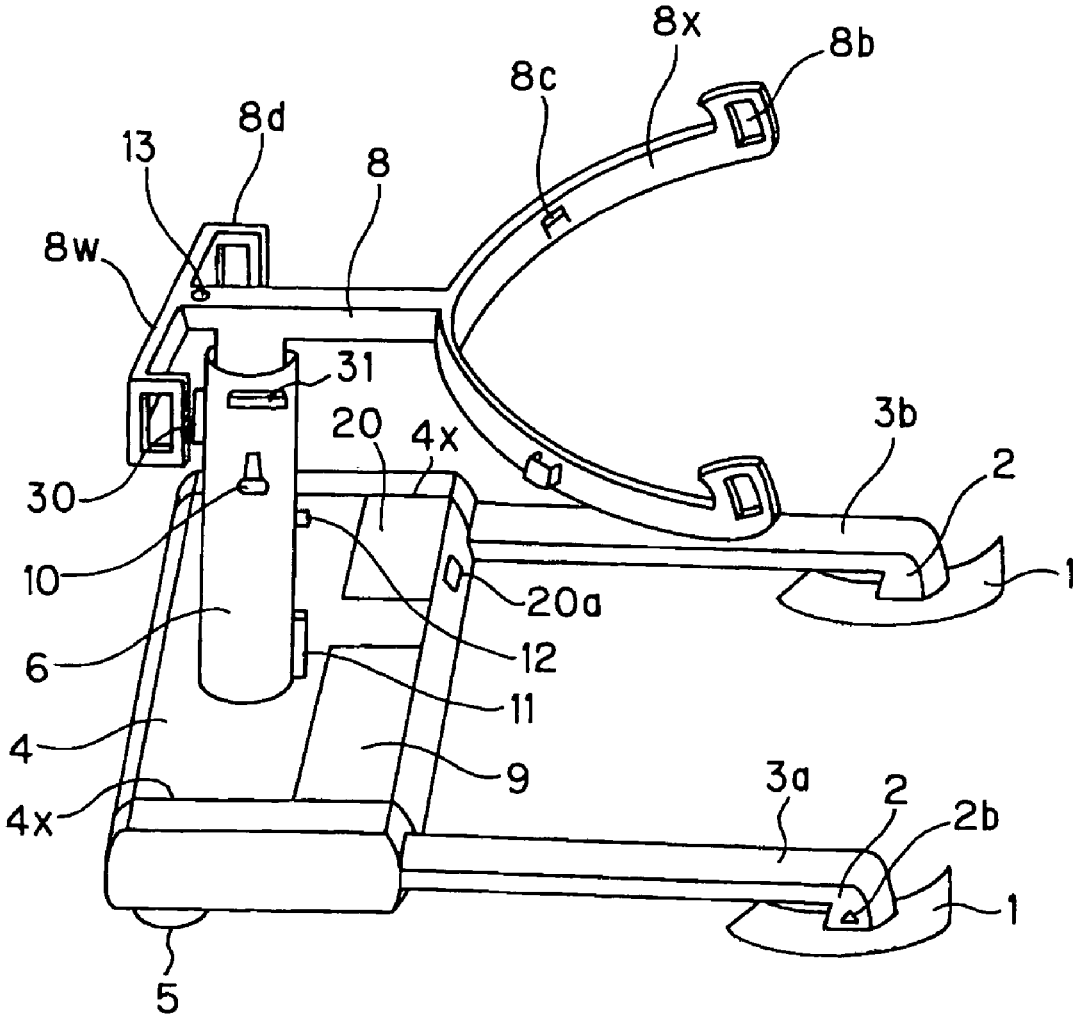
FIG. 1 is a perspective view that shows a motivative exercise and lifting aid dual device as a whole.
Figure 2:
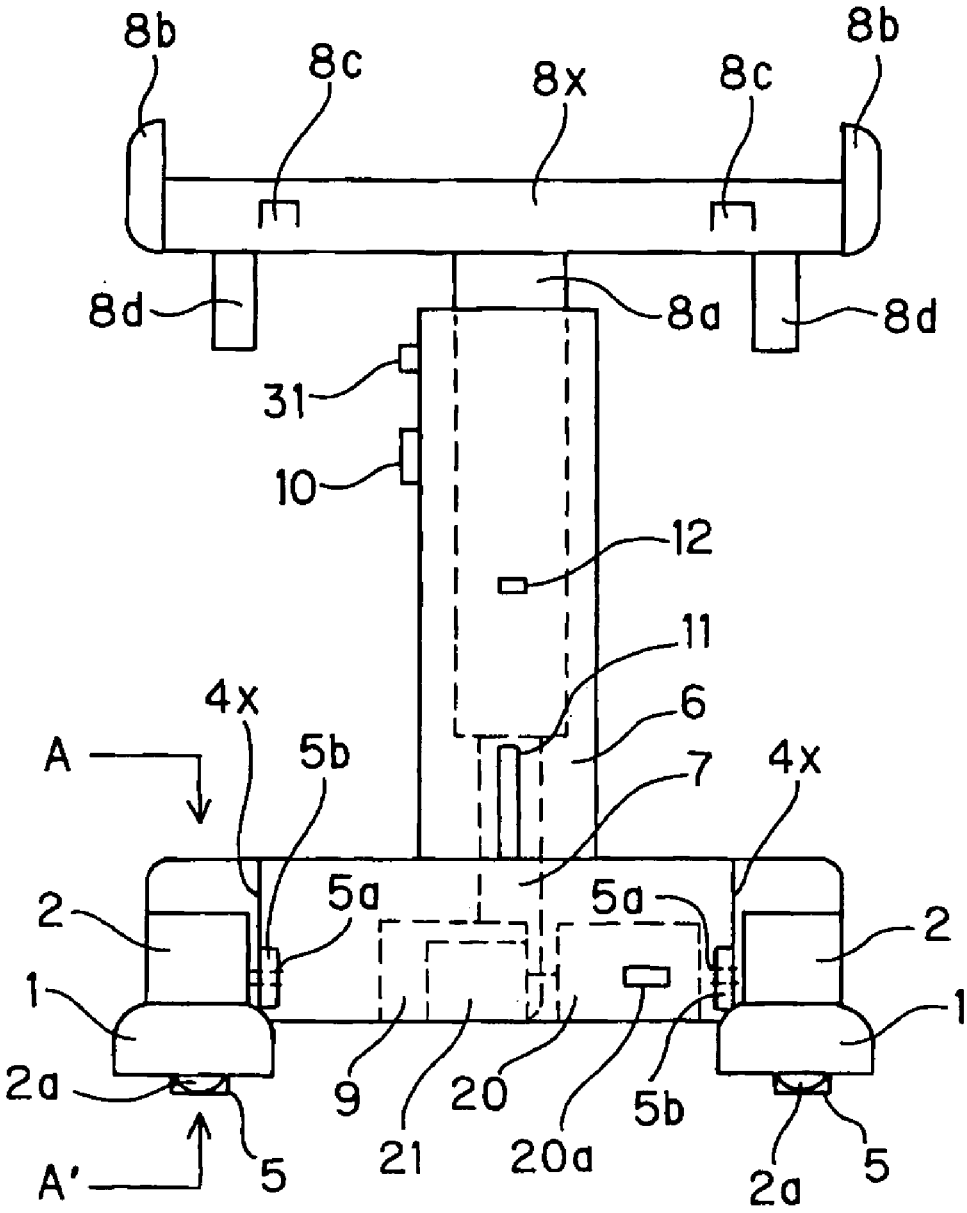
FIG. 2 is an elevation view of the same embodiment.
Figure 3:
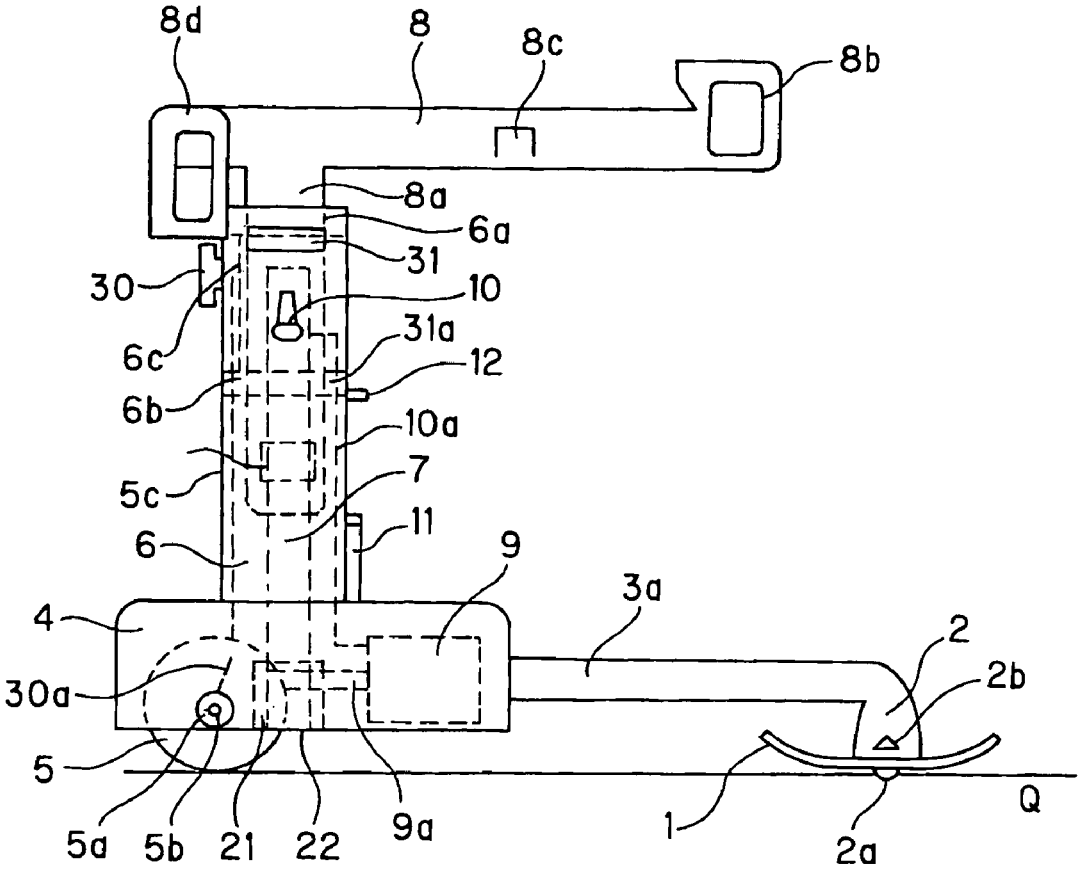
FIG. 3 is the side view elevation view of the same embodiment.
Figure 4:
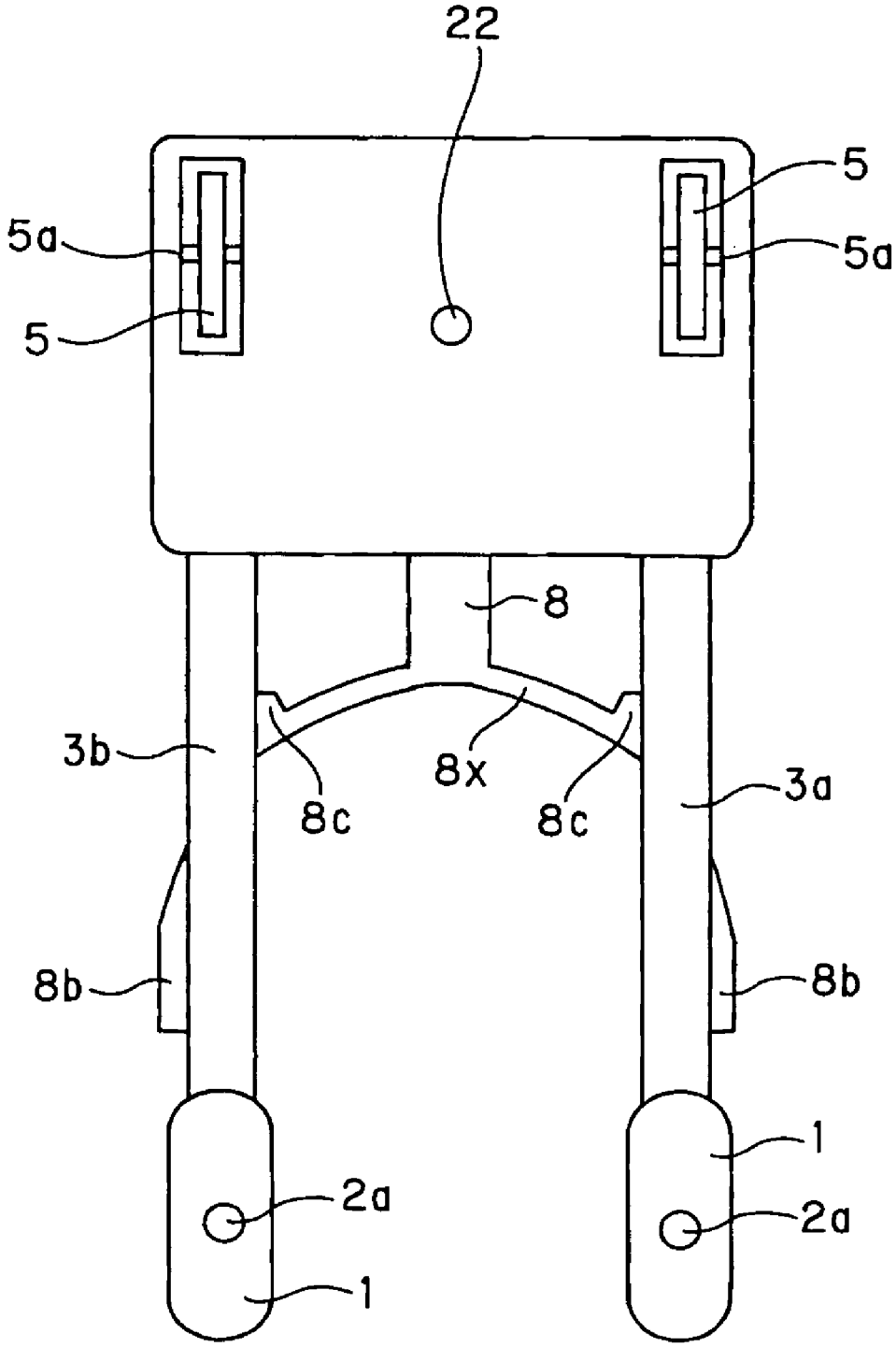
FIG. 4 is a bottom plan view of the same embodiment.
Figure 5:
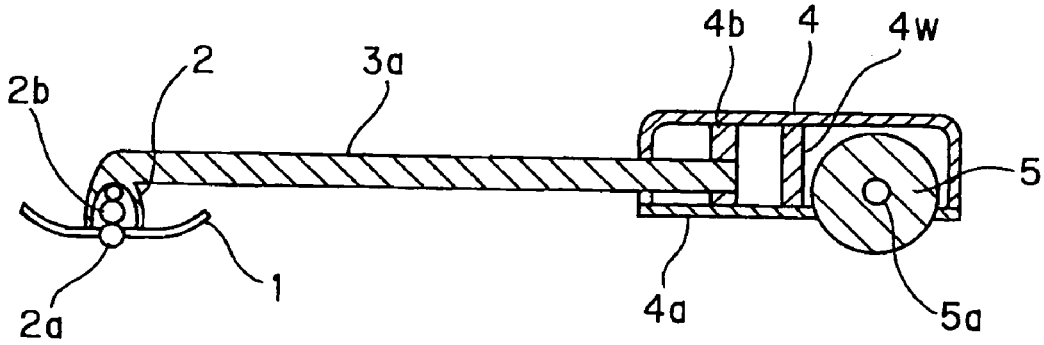
FIG. 5 is an expanded sectional view of A–A' of the same embodiment.

Then the inventor describes the embodiment in accordance with FIGS. 1 to 7.

A motivative exercise and lifting aid dual device has enough height to raise a person who can't sit up from the bed by oneself and it has stable length for the upper extremities training.

For an example in this embodiment, the height from a surface to move (Q) to the running-pulling arm (8) of the motivative exercise and lifting aid dual device is 80 cm, the entire length of the device is 90 cm and the width of the device is 60 cm.

The height of the tying device for training of upper extremities is 180 cm in use.

It is sufficient for those who have difficulty in sitting up by themselves that the device has enough height to raise them up on the bed and has a stable length for the upper extremities training to practice.

A motivative exercise and lifting aid dual device has leg poles (3*a*, 3*b*) which have casters (2) with plates (1) in order to get over the obstacles such as thresholds and gaps for moving at surfaces to move.

Even casters of JP 2979170 can substitute casters (2) with plates (1).

A caster (2) is composed of a wheel (2*a*) that is a ball and a brake of operating a plate (1) by hand in this embodiment.

The degree of the free movement of this invention is relatively high by shaping plate (1) to rise in the front and at the back in the same time.

Stability of this invention is secured by pulling up a wheel (2*a*) upward by the caster control device (2*b*) when the upper extremities' training is in practice.

Leg poles (3*a*, 3*b*) is composed by a pair of the corner shaped aluminum pipe and covered with the material which has a fixed elasticity such as urethane form and/or rubber in order to have waterproof and to secure safety.

Leg poles (3*a*, 3*b*) go through holes (It isn't illustrated) that set up in the front wall on the side of the hardware box (4) and are inserted into the inside of the hardware box (4), A hardware box (4) is made of the plastic.

Lines (4*x*) of the hardware box (4) are made lines at assemble members (4*b*) and the bearing housings which are composed between the hardware box (4) and the base (4*a*).

The bearing housings are assembled of the axle (5*a*) for the wheel (5) and have the waterproof function.

In other words, the hardware box (4) is divided into three rooms in the position of two lines (4*x*).

Leg poles (3*a*, 3*b*) are fixed by assemble members (4*b*) that are assembled between the upper part of a hardware box (4) and a hardware base (4*a*) inside of the hardware box (4) in the stability.

A hardware base (4*a*) is made of a plastic.

The hardware box (4) is a united structure without the hardware base (4*a*).

Though it isn't illustrated in this embodiment, the hardware box (4) and the hardware base (4*a*) are attached with screws and given waterproof processing with gland packing.

Assemble members (4*b*) are assembled between the hardware box (4) and the hardware base (4*a*) to ensure the safety of the leg poles (3*a*, 3*b*).

An assemble member (4*b*) is glued to the hardware box (4) and the hardware base (4*a*).

The assemble members (4*b*) are used in order to secure the leg poles (3*a*, 3*b*) that go through the perforated hole on the front side of the hardware box (4), in the stability in this embodiment.

The leg poles can be integrated with the hardware box (4) and the hardware base (4*a*) and/or means for assembling the leg poles such as welding and screw clamp are available in order that the leg poles (3*a*, 3*b*) are assembled in the stability.

Though it isn't illustrated, wheels (5) and axles (5*a*) are composed in the inside of a hardware box (4) on the place between the sidewall of the hardware box (4) and the position of the make-up line (4*x*).

A waterproofing wall (4*w*) is assembled between inside of the sidewall of the hardware box (4) and an inner wall shown with the make-up line (4*x*).

The inner wall shown with the make-up line (4*x*) and the waterproofing wall (4*w*) are provided to waterproof the driving part (9) and the energy supply device (20).

These are not required when each the driving part (9) and the energy supply device (20) itself are waterproofed.

Bearing housings of the axle (5*a*) for the wheel (5) can be assembled separately in the former case. A brake (5*b*) is assembled on the axle (5*a*) through the inner wall shown with the make-up line (4*x*).

Though a drum brake is being used for the brake (5*b*) in this embodiment, any kind of brake can be used.

When a brake switch (30) is pushed, the brake (5*b*) works through the cable (30*a*) and stops the movement of the motivative exercise and lifting aid dual device.

When the brake switch (30) is pushed, the brake device brakes.

Though it isn't illustrated, the brake switch (30) has a lock system that enables to keep the braked condition after pushing the switch.

The brake switch (30) has to be pushed again to release the brake.

The brake has to be locked in the use of the motivative exercise and lifting aid dual device for the upper extremities exercise.

The brake can also be locked in conjunction with the caster (2) due to operating the caster control device (2*b*).

A driving part (9) which drives a running-pulling arm (8), an energy supply (20), a power transmission (21) which transmits the power from the driving part (9) to the hoisting part (7) and a hoisting part securement (22) that enables to turn the hoisting part (7) freely, are composed on the hardware base (4*b*).

A driving part (9) is a motor in this embodiment.

An energy supply (20) is a storage battery.

A terminal (20*a*) is assembled on the front surface of the hardware box (4).

A terminal (20*a*) supplies electric power to the energy supply (20) which is a storage battery.

The rotation of a shaft (9*a*) by the rotation of the driving part (9) is transmitted to the hoisting part (7) by the gear rotation of the power transmission (21) with a gear.

The hoisting part (7) is assembled where a hoisting part securement (22) and rotates.

The hoisting part (7) is the screw mechanism that a screw was framed.

A running-pulling arm component (8*a*) which is related apparatus of the running-pulling arm (8) for hoisting is hollow and assembles a hoisting part (7).

The running-pulling arm component (8*a*) and the hoisting part (7) that a screw is framed are assembled to the running-pulling arm component (8*a*) with the nut mechanism (87) that is fixed to the running-pulling arm component (8*a*) with rotation freely.

A running-pulling arm (8) moves up and down based on the rotation of the hoisting part (7) as a nut moves by the rotation of the screw.

The hoisting controller (10) is assembled in the guide (6) and is connected to the driving part (9) with the hoisting controller transmission line (10*a*).

A motor of the driving part (9) rotates as the running-pulling arm (8) will rise when care person pulls the hoisting controller (10) toward to the care people in other words on the side of a running-arm (8*w*) of the running-pulling arm (8) on the FIG. 1 in this embodiment.

When the hoisting controller (10) is pushed on the opposite direction, the running-pulling arm (8) descends.

The direction of the rotation of the motor is set up with the installation of a screw cutting.

A clutch mechanism can be assembled in the power transmission (21) that is a gear mechanism.

In the former case, it is good that such as a rotary switch substitute for the hoisting controller (10) and control the clutch mechanism.

The guide (6) is composed of an integrated combination of the hardware box (4).

And then a stable device (6*a*) is assembled at the upper part of the guide (6) and a stable device (6*b*) is assembled at the inside of the guide (6).

Because the guide (6) is composed of an integrated combination of the hardware box (4) and the stable device (6*a*) and the stable device (6*b*) are assembled, the hoisting part (7) and a running-pulling arm component (8*a*) to move the running-pulling arm (8) up and down can be secured in the stability.

When the running-pulling arm component (8*a*) has moved to the highest position, the bottom part of the running-pulling arm component (8*a*) will not overstep the stable device (6*b*).

The running-pulling arm component (8*a*) is always secured by the stable device (6*a*) and the stable device (6*b*). Therefore, an up-down movement is done in the range of 15 cm.

A stable device control mechanism (31) is assembled at the top of the hoisting part (7.)

The stable device control mechanism (31) is a brake switch, which applies a brake when it is pushed.

The stable device control mechanism (31) controls the stable device (6*a*) and the stable device (6*b*) that are breaks which have smooth surface not to obstruct the rotation and/or the up-down movement of the running-pulling arm component (8*a*), The stable device (6*a*) and the stable device (6*b*) are stable devices for the running-pulling arm component (8*a*) in the case that they are not used as a break.

And then, the stable device (6*a*) and the stable device (6*b*) will not obstruct the rotation of the running-pulling arm (8) in times of lifting a handicapped person for transference and/or preparing to use.

Synthetic rubbers are used for the surface of the stable device (6*a*) and the stable device (6*b*) in the embodiment.

A brake works by the indication of the stable device control mechanism (31) in times to transfer a handicapped person.

An indication of the stable device control mechanism (31) is transmitted by a control transmission cable (6*c*).

The control transmission cable (6*c*) is a brake cable.

The stable device (6*a*) and the stable device (6*b*) put a drum break to use for the running-pulling arm component (8).

The stable device control mechanism (31) has a lock mechanism, though it is not illustrated.

When the brake brakes by pushing it then the brake stays to be on.

You need to push once again in order to release the break.

When you transfer a handicapped person, it is used with the brake locks on.

A running-pulling arm (8) is composed of a running-pulling arm component (8*a*), a running arm (8*w*), and a pulling arm (8*x*).

A nut mechanism (87) is fixed to the running-pulling arm component (8*a*).

By the effect of the nut mechanism (87), the running-pulling arm (8) moves up and down by the rotation of the screw of the hoisting part (7).

Running-grips (8*d*) and a hole (13) for the tying device for training of upper extremities are assembled in the running-arm (8*w*).

Keeping bosses (8*c*) and keeping grips (8*b*) for a boatswain's chair (40) is assembled on a pulling arm (8*x*).

The running-pulling arm (8) is made unified by aluminums, and it can hoist an object weigh up to 200 kilograms.

The running-pulling arm (8) contains enough strength to use as a lifting device for the motivative exercise and lifting aid dual device.

Though the running-pulling arm (8) is an aluminum casting in the embodiment, if it has enough strength for the use as a lifting aid, it is also good such as a plastic casting.

Also, it is made unified as the running-pulling arm, but it may be constructed separately as a running arm and a-pulling arm.

Running-grips (8*d*) are assembled to be convenient for the use of the care person. A form can be taken in other forms. For example, it may take a form like a car handle.

Figure 6:
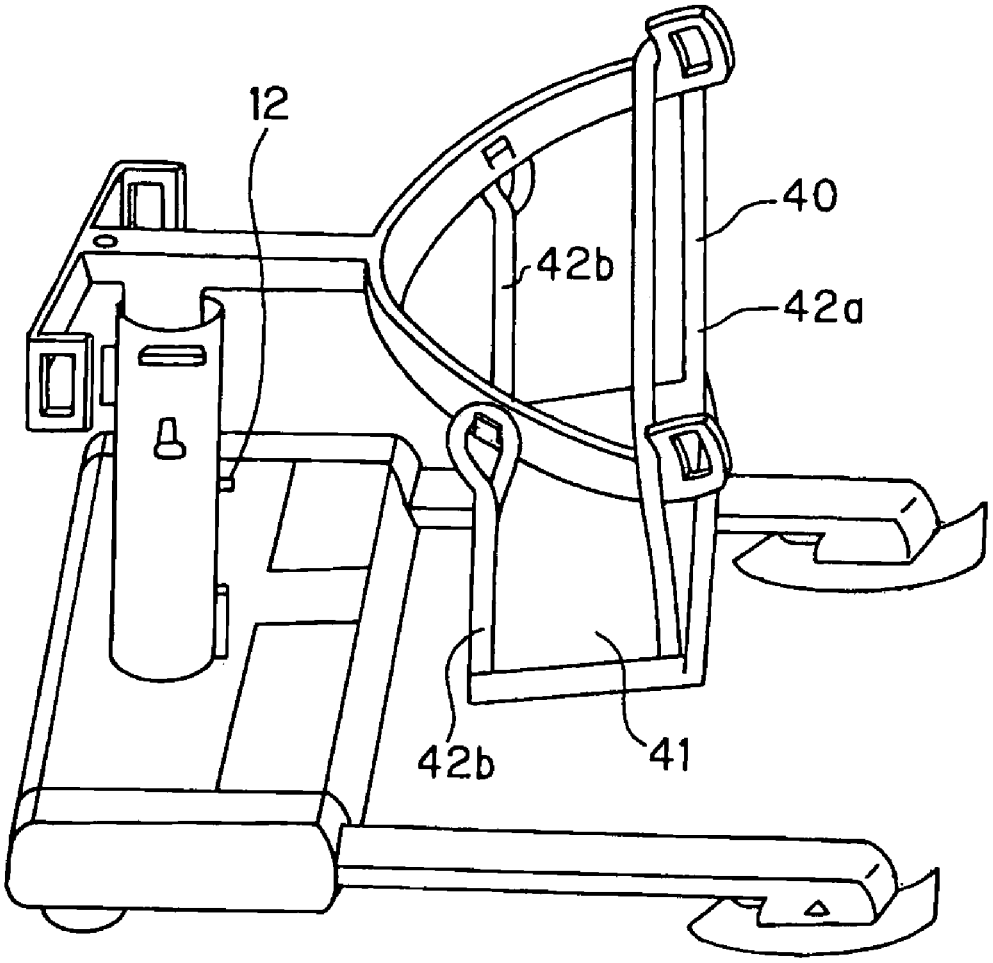
FIG. 6 is a perspective view of a lifting aid in use of the same embodiment.
Figure 7:
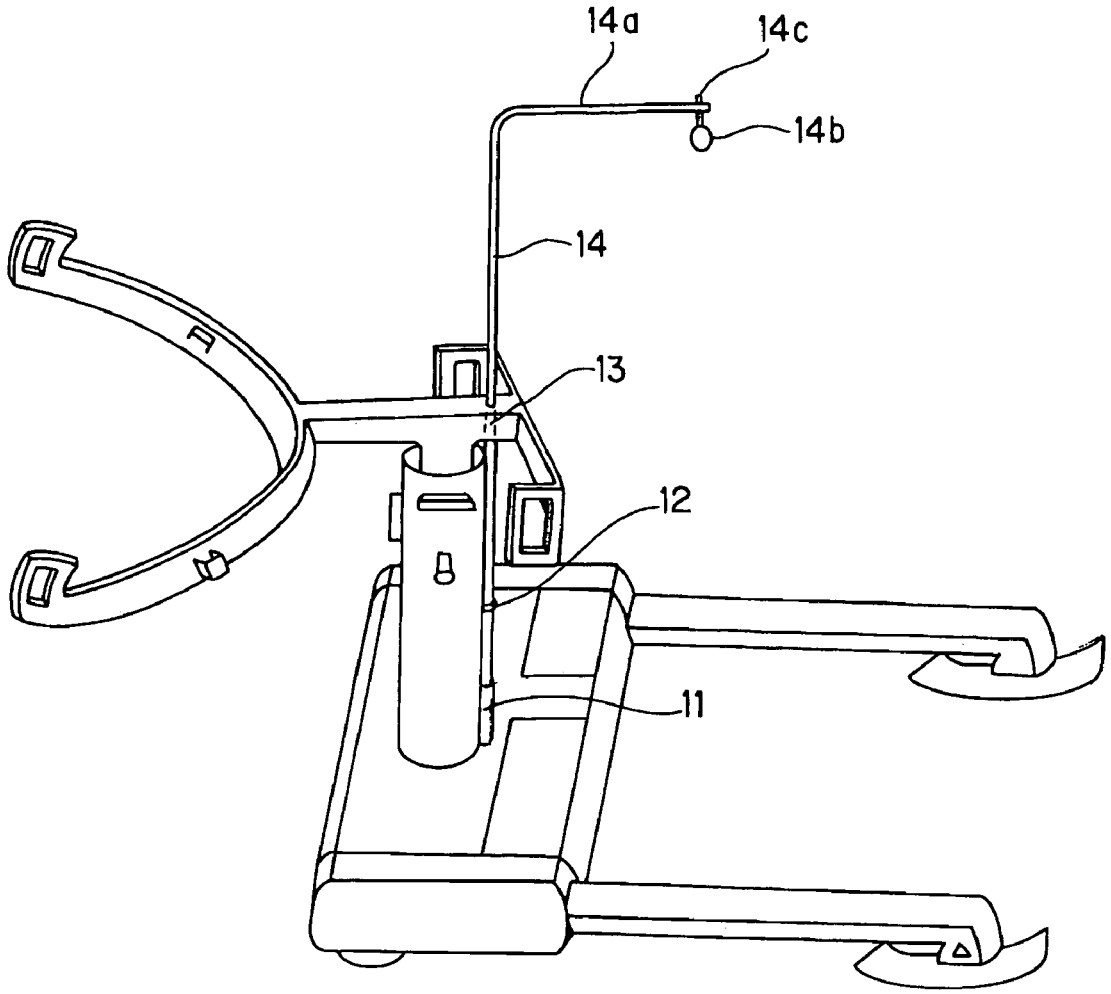
FIG. 7 is a perspective view of a tying device for training of upper extremities in use of the same embodiment.

A boatswain's chair (40) is set on the two keeping bosses (8*c*) and keeping grips (8*b*) that are set on a pulling arm (8*x*) as shown in FIG. 6.

A boatswain's chair (40) is consisted of a seating part (41) which is made of wood and bell ropes (42*a*, 42*b*) which are made of strengthening nylon.

The bell ropes (42*a*, 42*b*) in FIG. 6 can bear to the load of 100 kilograms.

It can be changed by the user's weight.

The bell rope (42*a*) is annular but it also enables to be in an independent cord as the bell rope (42*b*).

The bell rope (42) and the bell rope (42*a*) are used adjusting length by a user's height.

It is good that the seat part (41) could have a component to install to the member of the tying device for training of upper extremities (12) in order to enhance stability.

The running-pulling arm (8) is set not to overstep the stable device (6*b*) that is set on the guide (6) in the embodiment, but it can overstep the stable device (6*b*) if the stable device (6*a*, 6*b*) are enable to liberate greatly.

Therefore, the running-pulling arm (8) is removable.

Also, if the hoisting part (7) is shaped as a pipe-and a hollow form, the running-pulling arm (8) can be removed and then the tying device for training of upper extremities (14) enable to insert inside and to use.

A tying device for training of upper extremities (14) is a pipe which measures about 165 cm and is bent at the top in the abbreviation of 90 degrees angle.

In the embodiment, an erector pipe manufactured by Yazaki-Kakou is being used.

The bent and processed part is abbreviation of 40 cm. And though it isn't illustrated, a hole was assembled in order to insert a screw (14*b*) that has a ring part and the screw (14*b*) is fixed by the nut (14*c*) at the top part.

When it is actually used, a pulley that is composed of a part for the upper extremities training device is set on the ring part In the embodiment, the tying device for training of upper extremities (14) stands from the hardware box (4).

The tying device (14) goes through a member of the tying device for training of upper extremities (11) which is glued and fixed to the guide (6), a member of the tying device for training of upper extremities installation device (12) which is glued and fixed to the guide (6) and a hole for the tying device for training of upper extremities (13) respectively for training of upper extremities.

Heretofore, the inventor have explained the embodiment of this invention in detail, however it isn't limited to the embodiment, it is possible to make various changes from the embodiment within the confine of the claims of this invention.

The change example of this invention is illustrated in the following.

(1) Although a guide that goes up and down is set at a hardware box that is a machine storage part, the guide also can be assembled into the bottom of the hardware box as a base, too.

It also is possible to not set a guide which goes up and down.

It also can be changed according to the movement structure of up and down going of the hoisting part.

For example, a winch could be used to control the up and down movement of the hoisting part by hand.

In such case, a manual handle can take place to the hoisting controller that controls the hoisting driving part.

(2) The arrangement of the wheels and its quantity can be changed appropriately.

Though, it is preferred to assemble the wheels in every direction of the bottom in order to use as a transfer-move lift or for the upper extremities training of the motivative exercise and lifting aid dual device.

(3) The boatswain's chair can be set on a pulling arm.

Two keeping bosses and two keeping grips were arranged on the pulling arm but arrangement and quantity could be changed appropriately.

Also, the seat is made of wood, but the unity formed material with enough strength like plastic could also can be used.

Convenience levels rise more if it is constructed in the form of the toilet seat.

(4) A pipe bent in the abbreviation ninety degrees is used for the tying device for training of upper extremities (14).

It is possible to use such as a stainless steel pipe instead of the ready-made pipe in the embodiment.

It is also good even if not to be a round-shaped pipe.

In other word, if a material can support the pulling movement of up to 60 kilograms, any material can be used.

Use possibility in industry

Multiple kinds of products for care giving such as a lift from the bed that are used for gait difficulties or handicapped people who have difficulties even to get out of their beds in themselves and/or a bathing assistance device for them have been served in the prior art.

But the practical uses of the lifting aids with wheels were poor in the environments of step difficulties.

A lifting aid of this invention can be used at ease because of the practical use is high and the labor of the care giver is reduced due to moving freely for the care work in the house with steps.

Heretofore, though it is the most desirable that the care giving is connected with the handicapped person's independence, its realization was difficult.

But now it is possible for handicapped people to be advance in independence from care reliance by providing the upper extremities exercise device for the motivative exercise in home available.

When a care giving devices are used at home it is mostly used in small areas, but this invention can be used in small areas effectively by having two purposes of using by one utensil.

The purposes are to use the functions of both a free movement of care works in the house with the obstacles such as a step and a rehabilitation device.

What is claimed is:

1. A lifting aid for the care of a user comprising;

a support base;

a hoisting guide on said support base;

an arm arranged on said hoisting guide, said arm being configured to move vertically with respect to said support base;

a seat part for the user suspended from said arm;

front wheels and back wheels which enable movement of said support base, an aperture in said arm; and a tying device for training or rehabilitation of upper extremities of the user that passes through said aperture and attaches to said support base.

2. A lifting aid for the care comprising;

a support base, a hoisting guide on said support base, an arm arranged on said hoisting guide, said arm being removable and configured to move vertically with respect to said support base;

a seat part for the user suspended from said arm;

front wheels and back wheels which enable movement of said support base;

a pipe positioned inside said hoisting guide; and a tying device for training or rehabilitation of upper extremities of the user which is inserted into said pipe when said arms are removed from said hoisting guide.

3. A lifting aid according to claim 1 or 2, further comprising a plate having a front end being upwardly curved, said plate arranged near each front wheel permitting said wheel to traverse steps and gaps.

4. A lifting aid according to claim 1 or 2, further comprising a power-assist mechanism on at least one of said wheels.

* * * * *